United States Patent [19]

Rosenbusch

[11] 4,134,584

[45] Jan. 16, 1979

[54] VERSATILE ARM SKATE

[76] Inventor: Doris F. Rosenbusch, 3769 Inglewood Blvd., Los Angeles, Calif. 90066

[21] Appl. No.: 819,326

[22] Filed: Jul. 27, 1977

Related U.S. Application Data

[63] Continuation-in-part of Ser. No. 711,697, Aug. 4, 1976, abandoned.

[51] Int. Cl.[2] ..... A63B 21/06; A63B 21/22

[52] U.S. Cl. ..... 272/117; 272/67; 272/127

[58] Field of Search ..... 272/127, 117, 143, 116, 272/DIG. 4, 93, 67; 46/97, 106, 201; 280/DIG. 2, 3, 6 R, 29; 16/18 R, 45, 48

[56] References Cited

U.S. PATENT DOCUMENTS

| | | | |
|---|---|---|---|
| 2,642,286 | 6/1953 | Leroy | 272/127 |
| 3,797,824 | 3/1974 | Osbourne | 272/127 |
| 3,809,393 | 5/1974 | Jones | 272/127 |

FOREIGN PATENT DOCUMENTS

| | | | |
|---|---|---|---|
| 475746 | 11/1937 | United Kingdom | 280/3 |

*Primary Examiner*—Richard T. Stouffer
*Assistant Examiner*—William R. Browne

[57] ABSTRACT

A versatile arm exercise skate is provided having a weight distribution which tends to unbalance the skate as it is rolled by a patient, thereby forcing the patient to exercise muscular control and coordination to prevent tipping. The skate utilizes a base plate mounted on three rotatable casters, a stem mounted in the base plate, and a handle on the stem for gripping by the patient. By appropriate selection of stem height, handle weight and toroidally shaped weights centrally disposed over the stem and supported by the base plate, an exercise device is provided which will tend to tip as it is rolled over a variety of surfaces.

13 Claims, 3 Drawing Figures

FIG. 1
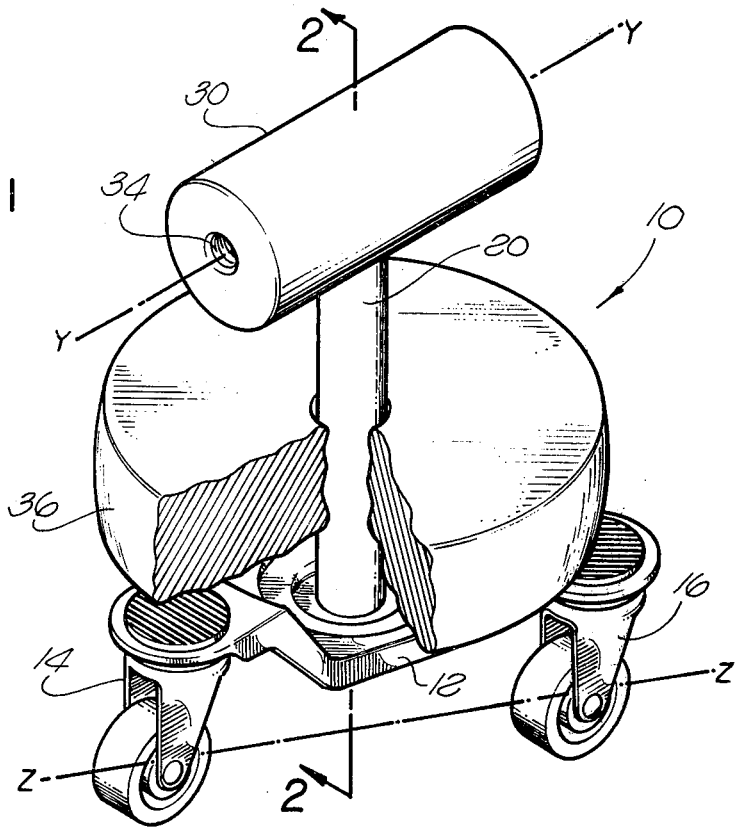
FIG. 2
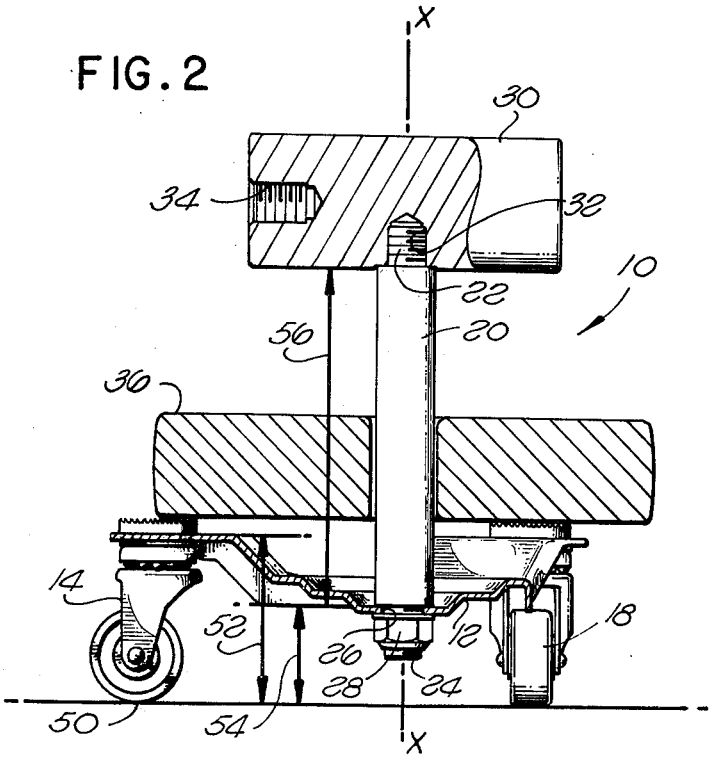
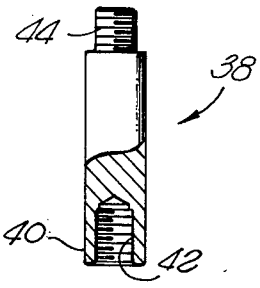
FIG. 3

VERSATILE ARM SKATE

CROSS REFERENCE TO RELATED APPLICATION

This application is a continuation-in-part of U.S. patent application Ser. No. 711,697 filed Aug. 4, 1976, now abandoned, entitled VERSATILE ARM SKATE.

FIELD OF THE INVENTION

The invention relates to arm exercise devices, and more particularly to relatively small, rollable, hand controlled arm and wrist exercise devices.

BACKGROUND OF THE INVENTION

Methods for exercising arms and wrists and improving the muscular coordination thereof are many and varied. One device previously utilized consisted of three rotatable caster wheels mounted to a base plate and an elongated stem, one end of which was mounted in the center of and normal to the base plate and the other end of which supported a handle. With this device a patient griped the handle and rolled the base plate along a predetermined path, thereby improving his arm coordination and strengthening his muscles. Although this device did allow the patient to exercise his arm muscles and improve coordination, it did not provide sudden rotational movements or rotational forces about the base for the arm and wrist muscles to overcome because it was designed to remain stable as it roled and needed to be tipped at an angle greater than 45 degrees to become unstable.

Another exercise device consisted of a handle rotatably mounted to an axle connecting two wheels as described in German Pat. No. 2,157,667 dated May 24, 1973. Both the axle and handle mounting apparatus could be variously weighted. Although this apparatus provided for handle rotational movements, it only rotated in a plane normal to the longitudinal axis of the axle and its rotation occurred in an analog manner rather than suddenly, thereby making it difficult for the patient to realize that he did not exercise the muscular control required to maintain the handle stem in a vertical orientation.

The device disclosed herein eliminates the above-described problems by being weighted to provide a tendency to tip suddenly when rolled. This tipping tendency, which the patient must overcome, provides a more effective exercise technique for increasing shoulder, arm and wrist range of motion, muscle strength, coordination, speed and endurance.

SUMMARY OF THE INVENTION

The device consists of a base plate to which a plurality of casters are mounted, each spaced at substantially equal distances from and angular increments about a central point on the base plate. A vertically extending stem is removably mounted to the base plate and a handle is removably mounted to the top thereof. The weight of the base plate, length of the stem, and weight of the handle are chosen so that the device will have a tendency to tip over suddenly when rolled by rotating about an axis intersecting two adjacent casters.

In another embodiment of the invention, tipping moment characteristics can be varied by adding weights to the base plate, varying the height of the stem, and varying the weight of the handle. As the center of gravity is raised, the tendency to tip is increased as a patient gripping the handle begins to roll the device. The tipping occurs in a sudden, and somewhat startling manner and dramatically calls to the patient's attention that he is not exerting a sufficient stabilizing force through his arm and wrist muscles. The amount of stabilizing force required is determined by the length of the stem, the total weight of the device and the weight distribution which is largely determined by the weight of the handle and the additional weight added to the base plate. The patient rolls the device over a predetermined path on a surface, with the curvature of the predetermined path, the speed of rolling and the device tip-over angle being variables which can be changed as the patient's ability changes.

In one embodiment, three casters are utilized and the handle is adapted to attach to the stem with its longitudinal axis in either a horizontal or vertical position, thus requiring the hand to grip the handle in either an arm pronation of 90 degree supination posture in accordance with the exercise needs of the particular patient. Toroidally-shaped weights slip over the stem when the handle is removed, and are supported by the top of the base plate.

BRIEF DESCRIPTION OF THE DRAWINGS

FIG. 1 is a perspective view of a device of the present invention showing the handle horizontally disposed;

FIG. 2 is a cross-sectional, elevational view taken along line 2—2 of FIG. 1; and, FIG. 3 is an elevational, partially broken-away view of a stem lengthening section for use in one embodiment of this invention.

DETAILED DESCRIPTION

The versatile arm skate disclosed herein provides an arm and wrist exercise device which, when rolled by a patient, will tend to tip over unless the patient exercises care and somewhat precise muscular control to prevent tipping. The device consists of a base plate to which three casters have been mounted at 120 degree angular increments about a central point. A stem extends upwardly from the base plate and supports a handle for the patient to grip. The device is unbalanced sufficiently through a proper selection of base plate weight, stem height, and handle weight so that one must utilize arm and wrist muscular control to prevent tipping. It is also weighted so that tipping occurs suddenly, thereby dramatically calling to the patient's attention that a stabilizing correction is needed.

Referring to FIGS. 1 and 2, the supportive and operative elements of the invention can be seen. The versatile arm skate exercise device 10 consists of a base plate 12, three rolling casters 14, 16 and 18 rotatably mounted to the base 12 and positioned at 120 degree increments about the axis X—X of a cylindrical elongated vertical member or stem 20. The stem 20 has a threaded upper end 22 and a threaded lower end 24, both of which have diameters less than that of the stem 20. A centrally disposed hole 26 having a diameter smaller than that of the stem 20 and larger than that of the stem lower end 24 is provided in the base plate 12 for receiving the stem lower end 24. A nut 28 screws onto the end 24 to secure the stem 20 to the base plate 12.

An elongated, cylindrical handle 30 contains a first threaded, countersunk bore 32 midway along its longitudinal dimension for receiving the stem upper threaded end 22. The handle 30 also contains a second threaded countersunk bore 34 at one end of the handle coaxial with the handle longitudinal axis Y-Y. One or more toroidally shaped weights 36 may be centrally disposed over the stem 20 and supported by the base plate 12.

A stem extension 38, shown in FIG. 3, has at one end 40 a countersunk threaded bore 42 adapted to screwably receive the threaded upper end 22 of the stem 20 and an opposed end 44 adapted to screwably receive the first or second handle bores 32 or 34.

In operation, it has been found that a large variety of handles 30, stems 20 and base plates 12 used in conjunction with toroidally shaped weights 36 weighing from 2-½ to 20 pounds provide the sudden and positive tipping action desired as a patient attempts to roll the exercise device by pushing or pulling on the handle 30. Handle weights slightly less than the combined weight of the stem 30 and the base 12 have been particularly effective. The weighted handle enhances the tendency to tip with the tipping constituting a rotational motion around a line through any two of the three casters 14, 16 and 18, such as the line Z—Z. The stabilizing effort required to oppose tipping as the device is rolled increases restoration of arm coordination. The threaded holes 32 and 34 in the handle 30 provide a means whereby the patient can help to restore hand strength and movement by positioning the wrist either horizontally or vertically when operating the device.

The tip-over angle for the skate 10 is defined as that angle formed between the vertical position of the stem longitudinal axis X—X and the tilted position of the axis X—X beyond which, when the handle 30 is released, the skate 10 will continue tipping and will not return to an upright position. It has been found that a skate 10 with a tip-over angle of approximately 25 degrees provides that degree of instability which is desirable for a patient to exercise his arms and wrists and improve muscular coordination. Tip-over angles between 20 and 30 degrees have been found to provide sufficient instability for proper exercise.

A tip-over angle of approximately 25 degrees is obtained in one embodiment utilizing a base plate 12 weighing one pound, casters 14, 16 and 18 spaced 4.75 inches from each other, and rollers 50 each 1-⅛ inches in diameter. The dimension 52 from top of the base plate 12 to the bottom of the three rollers is 2 inches. Dimension 54 from attachment point of the stem 20 and the base plate 12 to the bottom of the three rollers is one inch. The stem 20 is aluminum bar stock and has a diameter of 0.75 inches and a length 56 of 4.75 inches exclusive of the threaded upper end 22 and the threaded lower end 24. The handle 30, also of aluminum, has a longitudinal dimension of 4 inches and a diameter of 1.75 inches. With the above described skate 10 the tipping angle obtained is 24.78° according to the following formula:

Tip over angle =

$$\mathrm{Tan}^{-1}\left[1.625\left\{\frac{(W_1)+(W_2)+(d)_2+[(.043)(d)}{1+(.043)(d)+(.022)(d)+(2)(W_2)+(1.88)(W_1)+(W_1)(d)}\right\}\right]$$

where $W_1$ = weight of handle 30 in pounds $W_2$ = weight of 2 inch thick toroidally shaped weight 36 d = length 56 of stem 20 in inches with stem formed of 0.75 inch aluminum bar stock Base plate weight = 1 pound It will be appreciated from the above formula that as d is increased, the tip-over angle will decrease. Thus an appropriate toroidally shaped weight 36 must be added with a value determined according to the above formula to maintain the tipping angle at approximately 25 degrees.

The embodiment of the invention disclosed herein exemplifies the invention and is currently considered to be the best embodiment. However, it will be recognized that the embodiment of the versatile arm skate discosed may be constructed in various forms different from that shown and described. Accordingly, the specific structural details disclosed are representative and provide a basis for the claims which define the scope of the present invention.

I claim:

1. An exercise device for strengthening and coordinating wrist and arm musces comprising:

a base plate;

at least three wheels rotatably mounted on said base plate;

an elongated vertical member, a first end of said vertical member mounted to substantially the centroid of said base plate and extending upwardly from said base plate and terminating in a second end;

a handle;

means for mounting said handle to the second end of said elongated vertical member; and, means for creating a tip-over angle of less than 30 degrees for said exercise device, whereby said device continues to rotate, if unrestrained, about an axis intersecting an adjacent two of said wheels when a tipping force sufficient to pass said tip-over angle is imparted to said device through said handle, the continued rotation causing an imbalance condition for being resisted by a user of the device during exercise.

2. The device of claim 1 wherein said handle comprises a longitudinally extending member mounted so that its longitudinal axis is substantially horizontal.

3. The device of claim 1 wherein said handle comprises a longitudinally extending member centrally mounted at one end so that its longitudinal axis is substantially vertical.

4. The device of claim 1 wherein said handle mounting means comprises:

threads on the second end of said elongated vertical member; and a threaded bore in said handle to screwably receive said elongated vertical member threads.

5. The device of claim 1 wherein said means for creating a tip-over angle comprises said elongated member having a predetermined length.

6. The device of claim 1 wherein said means for creating a tip-over angle comprises a handle having a predetermined weight.

7. The device of claim 1 wherein said means for creating a tip-over angle comprises at least one weight supported by said base plate top surface.

8. The device of claim 7 having a tip-over angle greater than 20 degrees.

9. The device of claim 7 wherein said weights are toroidal in shape and have a central core disposable over said vertical member.

10. The device of claim 1 wherein the tip-over angle is about 25 degrees.

11. An exercise device for strengthening and coordinating wrist and arm muscles comprising:

a base plate;

an elongated vertical member having a first end and a second end, the first end mounted substantially to the centroid of said base plate and extending upwardly from said base plate;

three wheels rotatably mounted on said base plate, said wheels being spaced at substantially 120 degree increments about said elongated vertical member;

a handle mounted to said vertical member second end; and means for creating a tip-over angle of about 25 degrees, whereby said device after reaching said tip-over angle will continue to rotate, if unrestrained, about an axis intersecting two of said wheels when a tipping force sufficient to tip the exercise device past said tip-over angle is imparted to said device through said handle.

12. The device of claim 11 in which said means for creating said tip-over angle comprises an appropriate combination of said elongated vertical member length, said handle weight, and a predetermined weight toroidal in shape, said predetermined weight being supported by said base plate top surface and having a central case disposed over said elongated vertical member.

13. The device of claim 11 wherein the means for creating the tip-over angle comprises the elongated vertical member having a length, d, the handle having a weight, $W_1$, and a toriodally shaped weight having a weight value, $W_2$, the toroidally shaped weight being supported by the baseplate top surface and having a central core disposed over the elongated vertical member, the values of d, $W_1$ and $W_2$ being selected according to the relationship $$\text{Tip over angle} = \text{Tan}^{-1}\left[1.625\left\{\frac{(W_1) + (W_2) + (d_2) + (.043)(d)}{1 + (.043)(d) + (.022)(d) + (2)(W_2) + (1.88)(W_1) + (W_1)(d)}\right\}\right]$$

* * * * *